US006634394B1

(12) United States Patent
Nelson et al.

(10) Patent No.: US 6,634,394 B1
(45) Date of Patent: Oct. 21, 2003

(54) BALLOON INFLATION DEVICE

(75) Inventors: David C. Nelson, Akron, OH (US); Michael John Frazier, Waterloo, WI (US)

(73) Assignee: Premium Balloon Accessories, Inc., Sharon Center, OH (US)

( * ) Notice: Subject to any disclaimer, the term of this patent is extended or adjusted under 35 U.S.C. 154(b) by 0 days.

(21) Appl. No.: 10/092,798

(22) Filed: Mar. 7, 2002

(51) Int. Cl.[7] ..... B65B 31/00

(52) U.S. Cl. ..... 141/114; 141/97; 141/313; 53/79

(58) Field of Search ..... 141/10, 97, 114, 141/173, 197, 313–317; 53/79, 84, 88, 385.1, 403, 459, 469

(56) References Cited

U.S. PATENT DOCUMENTS

| | | | | | |
|---|---|---|---|---|---|
| 3,380,490 | A | | 4/1968 | Ellenberg et al. | |
| 3,561,579 | A | | 2/1971 | Allison | 194/1 |
| 3,692,071 | A | * | 9/1972 | Begleiter | 141/313 |
| 4,088,161 | A | | 5/1978 | Ikemoto | 141/167 |
| 4,094,347 | A | * | 6/1978 | Ikemoto | 141/313 |
| 5,067,301 | A | | 11/1991 | Shore | 53/79 |
| 5,121,595 | A | | 6/1992 | Shore | 53/79 |
| 5,370,161 | A | | 12/1994 | Shafer | 141/114 |
| 5,651,402 | A | | 7/1997 | McCaul | 141/314 |
| 5,653,272 | A | | 8/1997 | McCaul | 141/314 |

* cited by examiner

*Primary Examiner*—J. Casimer Jacyna
(74) *Attorney, Agent, or Firm*—Renner, Kenner, Greive, Bobak, Taylor & Weber

(57) ABSTRACT

The present invention provides an inflation block for a balloon inflation device including an inflation nozzle that is operatively connected to a source of pressurized gas, and a trough that substantially encloses the inflation nozzle in order to prevent access thereto by an operator's mouth, yet allowing for the insertion of the neck of a balloon thereon. The inflation nozzle is operatively connected to a slide valve that has a closed position and an open position. The slide valve is located between a source of pressurized gas and the inflation nozzle such that, in its closed position, the slide valve blocks the flow of gas from the source of pressurized gas through the inflation nozzle, and, in its open position, the slide valve opens the flow of gas from the source of pressurized gas through the inflation nozzle, in order to allow for the inflation of a balloon having its neck placed over the inflation nozzle.

9 Claims, 3 Drawing Sheets

BALLOON INFLATION DEVICE

BACKGROUND OF THE INVENTION

The invention herein resides generally in the art of balloon inflation devices. More particularly, the present invention relates to a balloon inflation device that is safe for consumer use.

The prior art has provided balloon inflation devices for filling balloons with lighter-than-air gases, like helium. These devices have been provided not only to facilitate the production of filled balloons but also to avoid some of the inherent dangers involved in using a pressurized gas to inflate balloons. Typically, trained personnel are required to operate balloon inflation devices that employ pressurized gas. Employing such personnel is an added expense of providing inflated balloons, and it is therefore desirable to provide a balloon inflation device that can be safely used by the average consumer.

Although several automated balloon inflation devices are available, there are very few readily usable by the average consumer. In some of these devices, the consumer has direct access to the source of pressurized gas. If the gas is an inert gas, such as helium, it is conceivable that the consumer could become asphyxiated if the gas was inhaled. Furthermore, if a consumer were to place their mouth directly on the nozzle of the pressurized gas supply, the pressure could severely injure that consumer's lungs.

U.S. Pat. No. 5,653,272 and U.S. Pat. No. 5,651,402 disclosed devices that prevent access to the pressurized gas supply by retaining a majority of the inflation device components inside a cabinet, and by assuring that a balloon placed on the inflation nozzle of the device is not inflated (i.e., pressurized gas is not released) until the cabinet is closed. These prior art inflation devices also divert a portion of the pressurized gas supply to activate a clamping mechanism for clamping the neck of the balloon over the inflation nozzle. These utilitarian aspects, while overcoming some of the inherent problems in balloon inflation as mentioned above, are not time efficient in use, and are more complicated in construction than is necessary.

Additionally, these prior art inflation devices positioned the inflation horizontally and provided a horizontal platform adjacent to the inflation nozzle to serve as a support for an uninflated balloon being filled by the inflation device. During inflation, the pressurized gas flowing through the nozzle and into the balloon would often cause the balloon to sway and fall off of the platform. Sometimes, this would cause the neck of the balloon and the valve therein to kink and self-seal preventing the flow of gas into the balloon and any further inflation. Thus, the position of the nozzle and the orientation of the balloon during inflation needs to be addressed in developing a more practical and consumer friendly inflation device There is also an inherent danger in the use of metallic, non-latex synthetic balloons filled with a lighter-than-air gas. It is well known that metalized synthetic balloons are conductive and if they come in contact with electrical transformers and power lines, the power lines may be shorted out causing a power failure in the immediate areas. Another danger of balloons filled with a lighter-than-air gas is that, after the gas escapes, the balloon may settle anywhere in the environment. As a result, the balloon may come into contact with wild life and cause unnecessary injury or, at the least, add to undesirable litter. In fact, some states have either enacted or are considering legislation to require the use of balloon weights to prevent the balloon from aimlessly floating away.

Based upon the foregoing, it is evident that there is a need for an automated balloon inflation device that can be safely used by the average consumer, and which is more time-efficient in use than prior art devices. Furthermore, if balloon inflation devices are to be made accessible to the consuming public, it is desirable to provide such a device in combination with empty balloons that already have a balloon weight associated with them, so that the balloon, once inflated, complies with any and all necessary state laws.

SUMMARY OF THE INVENTION

In general, the present invention provides a nozzle assembly for a balloon inflation device including an inflation nozzle that is operatively connected to a source of pressurized gas, and a trough that substantially encloses the inflation nozzle in order to prevent access thereto by an operator's mouth, yet allowing for the insertion of the neck of a balloon thereon.

In particular embodiments, the inflation nozzle is operatively connected to a slide valve that has a closed position and an open position. The slide valve is located between the source of pressurized gas and the inflation nozzle such that, in its closed position, the slide valve blocks the flow of gas from the source of pressurized gas through the inflation nozzle, and, in its open position, the slide valve opens the flow of gas from the source of pressurized gas through the inflation nozzle, in order to allow for the inflation of a balloon having its neck placed over the inflation nozzle. In more specific embodiments, the nozzle assembly further includes a collar associated with the inflation nozzle. The collar provides a place for sealing the neck of a balloon around the inflation nozzle such that, upon inflation of the balloon, gas does not escape between the neck of the balloon and the collar and inflation nozzle. Further, the collar is capable of being manipulated to move the slide valve between its closed position and its open position, thereby regulating the flow of gas.

The present invention also provides a balloon inflation device for consumer use. This balloon inflation device includes an inflation nozzle that is operatively connected to a source of pressurized gas, a trough that substantially encloses the inflation nozzle in order to prevent access thereto by an operator's mouth, while yet allowing for the insertion of the neck of a balloon thereon. Also provided is at least one pre-packaged empty balloon with an attached balloon weight, which balloon is provided at the balloon inflation device for purchase and for inflation with the balloon inflation device. By providing pre-packaged empty balloons with attached balloon weights for use in conjunction with the balloon inflation device, there is an assurance that consumers will be providing themselves with balloons that are in accordance with state laws regarding lighter-than-air balloons.

PREFERRED EMBODIMENT FOR CARRYING OUT THE INVENTION

Figure 1:
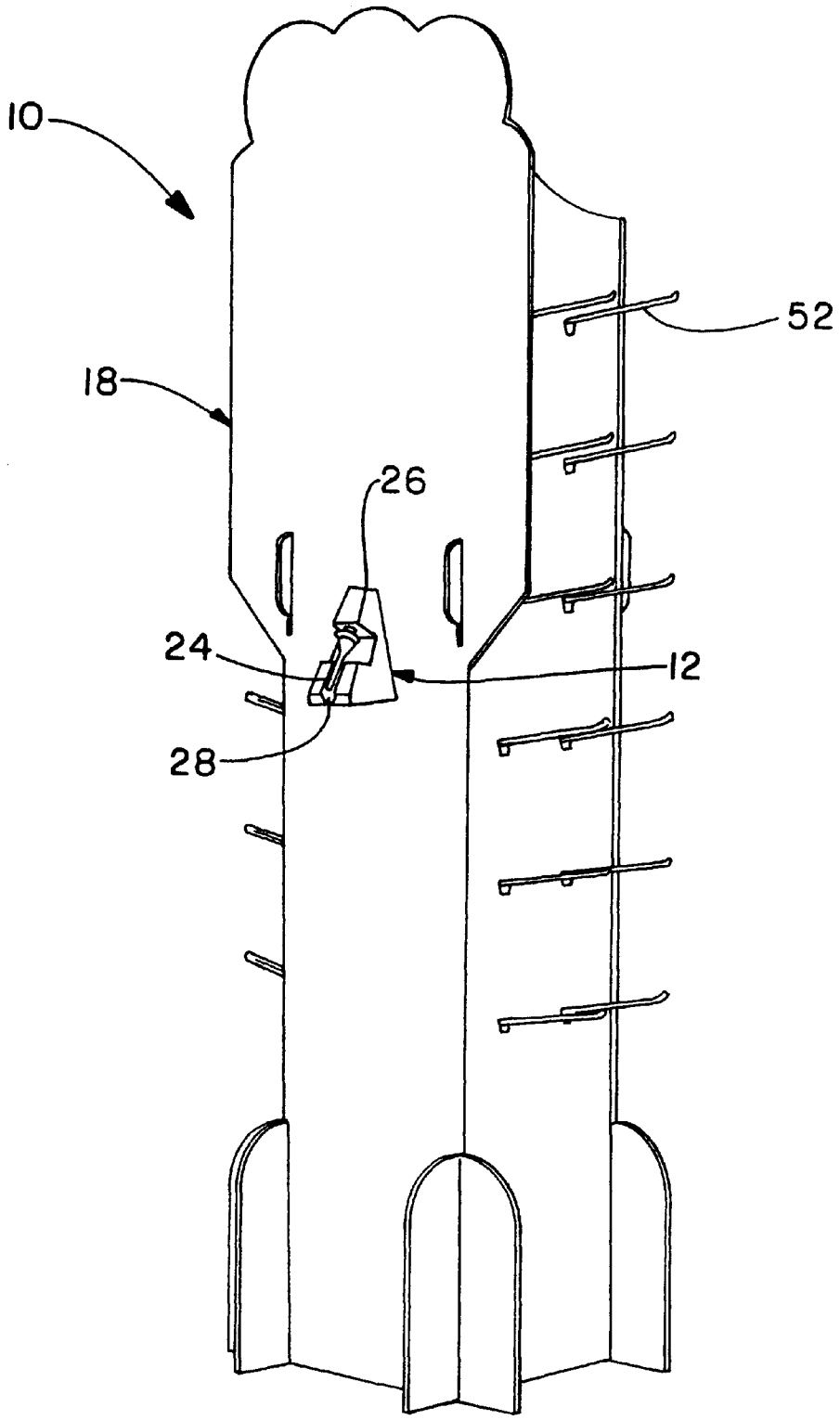
FIG. 1 is a perspective view of a balloon inflation device according to this invention.
Figure 2:
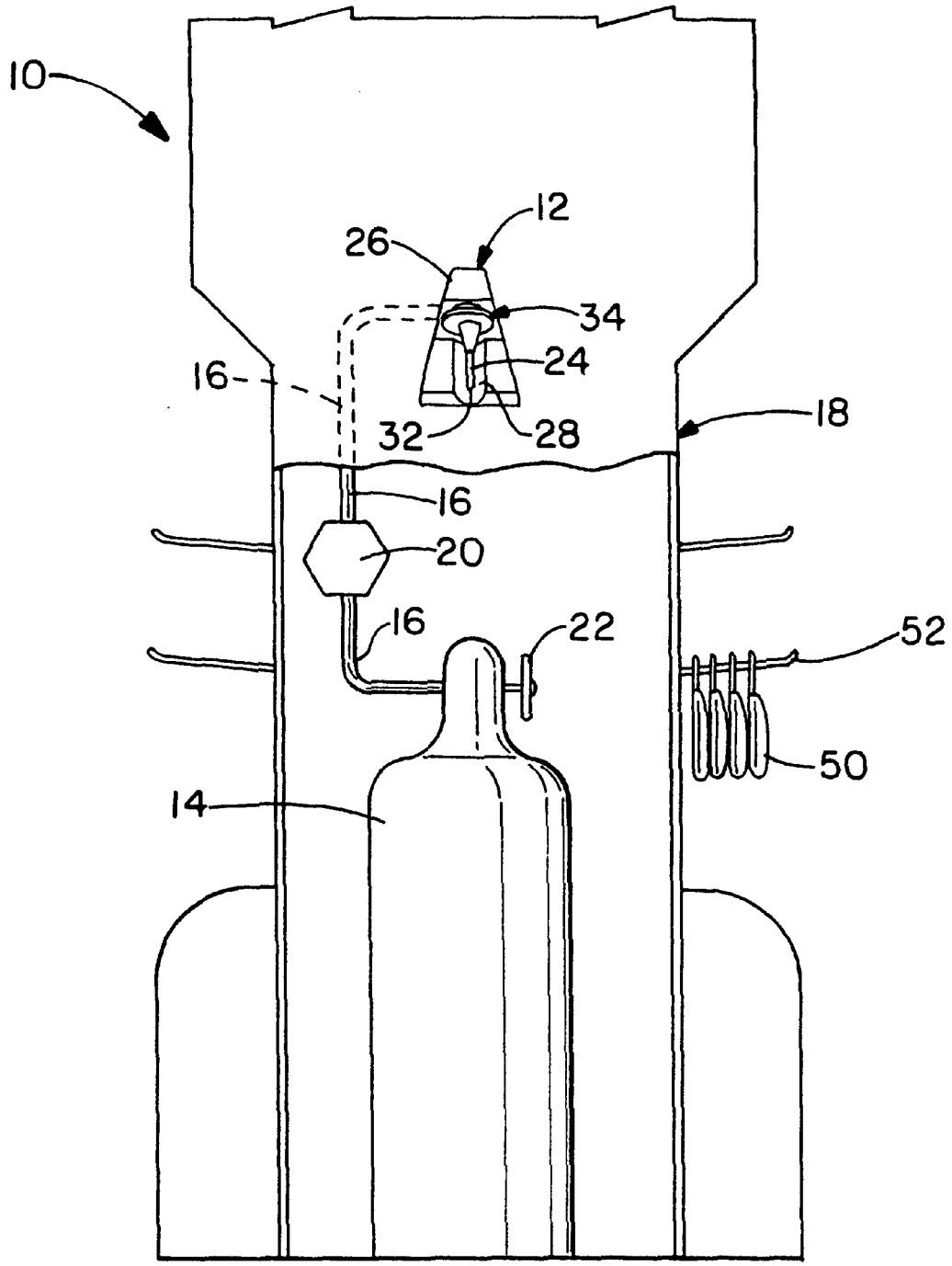
FIG. 2 is a front elevational view with a portion broken away from the balloon inflation device of FIG. 1.

With reference to FIGS. 1 and 2, it can be seen that a balloon inflation device according to the present invention is designated generally by the numeral 10. Balloon inflation device 10 includes an inflation block 12 that communicates with a pressurized gas source 14 through a feed line 16. For aesthetic reasons, as well as to restrict access to the pressurized gas source 14, the pressurized gas source 14 and feed lines 16 are preferably retained within a housing 18, while the inflation block 12 is provided on the outside of the housing 18 to allow for consumer access thereto for inflating balloons.

As is known, the gases employed to fill balloons, particularly helium, are typically supplied in pressurized tanks so that a large quantity of gas can be provided in a limited amount of space. Thus, the gas supplied is typically contained at a pressure of about 1500 to 2500 psi. This pressure is too great for inflating balloons. Therefore, at least one pressure regulator 20 is employed along feed line 16 to reduce the pressure of the gas traveling from the pressurized gas source 14 to the inflation block 12. Preferably, one or more pressure regulators 20 are provided to reduce the pressure of the gas to less than about 5 psi in order to ensure satisfactory inflation of the balloon. At such low pressure, a balloon will be sufficiently inflated so that it does not lose its shape or lift, while there is little chance for bursting of the balloon. Preferably, pressure regulator(s) 20 reduce the pressure to about 0.5 psi. As is common, the pressurized gas source 14 has an open/close valve 22. Typically, open/close valve 22 is left open to allow for the flow of pressurized gas from the pressurized gas source 14 through feed line 16. Open/close valve 22 may be left open due to the fact that, as described below, the inflation block 12 will not allow for the release of gas therethrough without actuation through inflation block 12.

Figure 3:
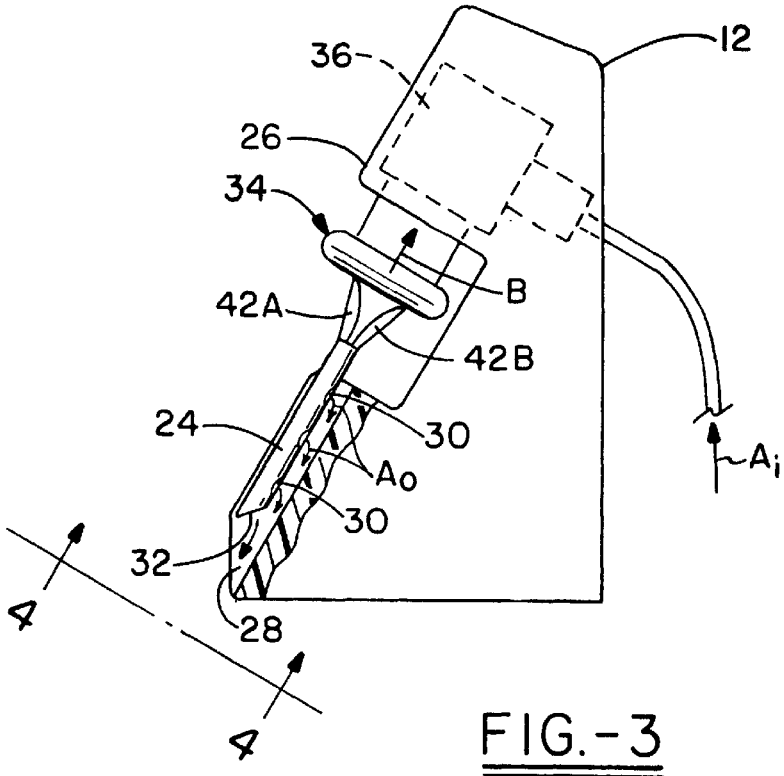
FIG. 3 is a side elevational view of the nozzle assembly of the balloon inflation device.

With particular reference to FIG. 3, it can be seen that inflation block 12 includes an inflation nozzle 24 extending from a base member 26. Base member 26 provides a 180° cylindrical trough 28, which substantially encloses the inflation nozzle 24 to provide several advantages. Due to the fact that the cylindrical trough 28 extends further than the tip of inflation nozzle 24, the cylindrical trough 28 prevents operators of balloon inflation device 10 from placing their mouth or lips over inflation nozzle 24 to thereby inhale the pressurized gas that flows therethrough once the inflation block 12 is activated as will be described below. The cylindrical trough 28 also helps prevents operators from accidently snagging their clothing on inflation nozzle 24 or poking themselves with the inflation nozzle 24. Although the cylindrical trough 28 is disclosed herein as extending through 180°, the present invention is not to be limited thereto or thereby. Rather, it is sufficient if a cylindrical trough 28 is provided about inflation nozzle 24 to realize at least the benefit of preventing operators from placing their mouth over the inflation nozzle 24.

Inflation nozzle 24 also preferably extends substantially downwardly, as is particularly clear from FIGS. 1–3, thus allowing for vertical inflation as opposed to the substantially horizontal inflation of the prior art. Vertical inflation is preferred because, when the balloon hangs downward during vertical inflation, the self-sealing valve in the balloon will be oriented in a direction that will prevent any possibility of kinking, which undesirably stops inflation. It is particularly preferred that the inflation nozzle 24 extends downwardly at an angle (as shown) because this angle leads the inflation nozzle 24 into the valve and through the neck of the balloon by favoring and pressing against the upper internal surface of the neck and valve as the neck of the balloon is pulled-up to sheathe the inflation nozzle 24.

In accordance with the advantage of preventing the inhalation of gas flowing through inflation nozzle 24, the inflation nozzle 24 is preferably provided with flutes 30, which allow pressurized gas flowing through the inflation nozzle 24 to exit at various positions, represented at arrows $A_0$ in order to decrease the ability of an operator to inhale a concentrated stream of pressurized gas exiting the inflation nozzle 24. Providing multiple flutes 30, also further depressurizes the gas and reduces inflation time. An additional preferred design aspect for the inflation nozzle 24, although not necessarily related to the prevention of gas inhalation, involves the provision of beveled tip 32 on inflation nozzle 24. This beveled tip 32 facilitates balloon inflation by aiding an operator in guiding the neck of a balloon over and up the inflation nozzle 24 for inflating the balloon.

A collar 34 is associated with inflation nozzle 24. Collar 34 serves as a location for sealing the neck of a balloon around inflation nozzle 24. More particularly, the operator of the balloon inflation device 10 feeds the neck of the balloon over inflation nozzle 24, at trough 28, and pulls the open valve in the end of the neck of the balloon into contact with the collar 34 such that the entire length of inflation nozzle 24 extends into the neck and self-sealing valve of the balloon. The operator then seals the neck of the balloon against collar 34 by using his or her hands, and, by pushing collar 34 upward, pressurized gas flow is actuated, allowing the balloon to be fully filled. Notably, pressure regulator(s) 20 also ensure proper inflation by ensuring that the internal pressure in the balloon does not exceed a predetermined limit, e.g. 0.5 psi. The cut-out portion of the inflation block 12 that provides access to collar 34 should be sized sufficiently to allow an operator to be able to pinch the neck of the balloon against collar 34 by use of his or her fingers and thumbs. A slide valve 36 is positioned on the feed line 16, between the inflation nozzle 24 and the source of pressurized gas 14, as represented at arrow $A_1$, and serves to selectively open and close the flow of gas from pressurized gas source 14 through the inflation nozzle 24.

Figure 4:
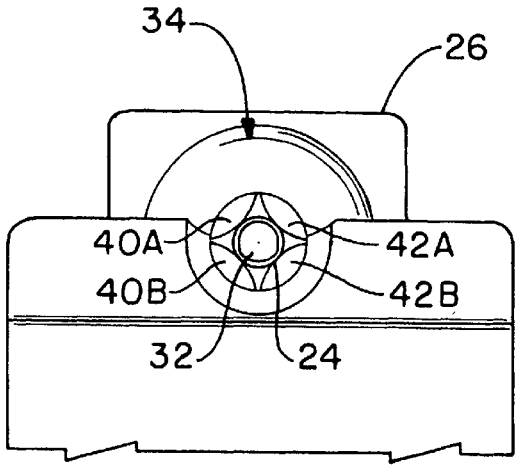
FIG. 4 is an end view of the balloon inflation device as taken from the vantage of line 4—4 in FIG. 3.

Referring to FIGS. 3 and 4, a preferred design for collar 34 is provided. Therein, collar 34 provides tapered sections 40A and 40B and 42A and 42B. It should be apparent that this shape will compliment the shape made by an operator's fingers when sealing the neck of a balloon against collar 34, and, thus, this preferred design aids in filling balloons by ensuring a better seal between the balloon and collar 34, thereby reducing and/or eliminating loss of gas (e.g., helium) during inflation when collar 34 is manipulated to inflate a balloon as described below. Particularly, the thumb and finger of the operator's left hand would seal against tapered sections 40A and 40B, while the thumb and finger of the operator's right hand would seal against tapered sections 42A and 42B.

In the preferred embodiment herein, slide valve 36 is operatively connected to inflation nozzle 24 and has a closed position, wherein the slide valve 36 blocks the flow of gas from the pressurized gas source 14 through the inflation nozzle 24, and an open position, wherein the slide valve 36 opens the flow of gas from the pressurized gas source 14 through the inflation nozzle 24. Although other design choices are available and will be evident to those of skill in the art after review of the present disclosure, the present invention operatively connects slide valve 36 to inflation nozzle 24 through collar 34. Manipulation of the collar 34 affects the movement of the slide valve 36 between the closed and open positions. Particularly, once the neck of a balloon has been sealed against collar 34, collar 34 may be moved in the direction of arrow B to open the normally closed slide valve 36 and allow gas to flow through inflation nozzle 24 and into the balloon sealed against collar 34.

Preferably, slide valve 36 is biased in the closed position such that, upon the release of force on collar 34 in the direction of arrow B, slide valve 36 automatically closes to prevent further inflation of a balloon disposed around inflation nozzle 24.

In this manner, a balloon can be quickly and safely inflated by any consumer that is able to read and follow instructions and/or diagrams substantively similar to the following: (1) locate inflation hole on the neck of the balloon; (2) insert inflation nozzle into the hole and pull the balloon neck to the top of the inflation nozzle; (3) seal the neck of the balloon against the collar at the top of the inflation nozzle, and push up on the collar to inflate the balloon; (4) fully inflate the balloon and then slide the balloon off of the inflation nozzle. These instructions are simple to understand and easy to follow, and, thus, the present invention provides a balloon inflation device that is an advancement over the prior art in at least its ease of operation. Additionally, safety features are provided by providing flutes in the inflation nozzle and by extending the inflation nozzle into a trough that extends longer than the nozzle to hinder access thereto.

Referring back to FIG. 1, an optional, yet preferred, aspect of a balloon inflation device of this invention will be disclosed. At least one pre-packaged empty balloon with an attached balloon weight (represented generally at the numeral 50) is provided for purchase and for inflation with the balloon inflation device. Particularly, the pre-packaged balloons with attached balloon weights hang from hooks 52 on the housing 18. By providing pre-packaged empty balloons with attached balloon weights 50 for use in conjunction with the balloon inflation device, there is an assurance that consumers will be providing themselves with balloons that are in accordance with state laws regarding lighter-than-air balloons.

While in accordance with the patent statues only the preferred embodiments of the present invention have been described in detail, the present invention is not to be limited thereto or thereby. Rather, the scope of the invention shall include all modifications and variations that fall within the scope of the attached claims.

What is claimed is:

1. An inflation block for a balloon inflation device comprising:

an inflation nozzle operatively connected to a source of pressurized gas; and a trough substantially enclosing said inflation nozzle for preventing access thereto by an operator's mouth while simultaneously providing for the insertion of the neck of a balloon thereon.

2. The inflation block of claim 1, wherein said inflation nozzle extends downwardly at an angle off of vertical.

3. The inflation block of claim 2, wherein said inflation nozzle includes a beveled tip.

4. The inflation block of claim 1, further comprising flutes in said inflation nozzle for allowing pressurized gas flowing therethrough to exit said inflation nozzle at various positions in order to accelerate inflation and decrease or eliminate the ability of an operator to inhale a concentrated stream of gas exiting said inflation nozzle.

5. The inflation block of claim 1, wherein said inflation nozzle is operatively connected to a slide valve having a closed position and an open position, said slide valve located between said source of pressurized gas and said inflation nozzle, wherein said slide valve blocks the flow of gas from said source of pressurized gas through said inflation nozzle, when said slide valve is in said closed position, and opens the flow of gas from said source of pressurized gas through said inflation nozzle, when said slide valve is in said open position.

6. The inflation block of claim 5, wherein said slide valve is biased in the closed position such that pressure must be applied against this bias to move said slide valve to said open position wherein pressurized gas is fed from said source of pressurized gas through said inflation nozzle, and, upon release of such pressure applied against said bias, said slide valve will return to said closed position wherein pressurized gas is not fed through said inflation nozzle.

7. An inflation block for a balloon inflation device comprising:

an inflation nozzle operatively connected to a source of pressurized gas;

a slide valve located between said source of pressurized gas and said inflation nozzle, wherein said slide valve blocks the flow of gas from said source of pressurized gas through said inflation nozzle, when said slide valve is in said closed position, and opens the flow of gas from said source of pressurized gas through said inflation nozzle, when said slide valve is in said open position;

a trough substantially enclosing said inflation nozzle for preventing access thereto by an operator's mouth yet allowing for the insertion of the neck of a balloon thereon; and a collar associated with said inflation nozzle, said collar allowing for the sealing of the neck of a balloon against said collar and around said inflation nozzle, said collar further being capable of manipulation for affecting the movement of said slide valve between said closed position and said open position.

8. The inflation block of claim 7, wherein said collar is provided in a cut-out portion of the inflation block that provides sufficient room to allow an operator to be able to pinch the neck of a balloon against said collar by use of his or her fingers and thumbs.

9. The inflation block of claim 8, wherein said collar includes tapered sections that compliment the shape made by an operator's fingers and thumbs when sealing the neck of a balloon against said collar.

* * * * *